US006332248B1

(12) United States Patent
Daniggelis et al.

(10) Patent No.: US 6,332,248 B1
(45) Date of Patent: Dec. 25, 2001

(54) WIRE HARNESS BOUNDING METHOD

(75) Inventors: Stephen Daniggelis, Tempe; Ray Martin, Scottsdale, both of AZ (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 09/526,140

(22) Filed: Mar. 15, 2000

(51) Int. Cl.[7] ..... B65D 63/00
(52) U.S. Cl. ..... 24/16 PB; 24/16 R; 24/30.5 P
(58) Field of Search ..... 24/16 R, 16 PB, 24/17 AP, 30.5 P, 30.5 S; 248/74.3

(56) References Cited

U.S. PATENT DOCUMENTS

| | | | | |
|---|---|---|---|---|
| Re. 31,689 | | 10/1984 | Bulanda et al. . | |
| D. 256,438 | * | 8/1980 | Woods | D8/394 |
| D. 369,960 | | 5/1996 | Rohaly et al. . | |
| D. 370,172 | | 5/1996 | Rohaly et al. . | |
| D. 380,375 | | 7/1997 | Rohaly et al. . | |
| D. 389,051 | | 1/1998 | Caveney et al. . | |
| 2,977,145 | * | 3/1961 | Rifkin | 24/16 PB |
| 3,224,056 | * | 12/1965 | Joffe | 24/16 PB |
| 3,739,429 | * | 6/1973 | Kohke | 24/16 PB |
| 3,949,449 | | 4/1976 | Caveney et al. . | |
| 3,965,538 | | 6/1976 | Caveney et al. . | |
| 3,996,646 | | 12/1976 | Caveney . | |
| 4,001,898 | | 1/1977 | Caveney . | |
| 4,003,106 | | 1/1977 | Schumacher et al. . | |
| 4,135,749 | | 1/1979 | Caveney et al. . | |
| 4,138,770 | * | 2/1979 | Barrette et al. | 24/16 PB |
| 4,188,004 | | 2/1980 | Fulton et al. . | |
| 4,191,334 | | 3/1980 | Bulanda et al. . | |
| 4,688,302 | | 8/1987 | Caveney et al. . | |
| 4,728,064 | | 3/1988 | Caveney et al. . | |
| 4,866,816 | | 9/1989 | Caveney et al. . | |
| 5,088,158 | * | 2/1992 | Burkholder | 24/16 PB |
| 5,103,534 | | 4/1992 | Caveney . | |
| 5,121,524 | | 6/1992 | Mortensen . | |
| 5,146,654 | | 9/1992 | Caveney et al. . | |
| 5,193,250 | | 3/1993 | Caveney . | |
| 5,267,373 | | 12/1993 | Chisek . | |
| 5,395,343 | * | 3/1995 | Iscovich | 24/16 PB X |
| 5,669,111 | | 9/1997 | Rohaly . | |
| 6,119,314 | * | 9/2000 | Freed | 24/16 PB |

* cited by examiner

*Primary Examiner*—Robert J. Sandy
(74) *Attorney, Agent, or Firm*—Robert Desmond, Esq.

(57) ABSTRACT

A novel wire bundle bounding method that meets the requirements of aerospace specifications is disclosed as well as a novel cable tie used in the method. The method starts with a bundle of wires and the cable tie. The cable tie has a strap body and a locking head with first and second strap passages. The first and second strap passages each have a pawl that locks in the same direction. The strap body is then wrapped around at least one of the wires and then inserted through the first strap passage. Then the strap body is wrapped around the bundle and then inserted through the second strap passage. The strap body is then tightened and the residual strap portion clipped.

7 Claims, 4 Drawing Sheets

WIRE HARNESS BOUNDING METHOD

TECHNICAL FIELD

This invention relates to methods for bounding a bundle of electrical cables and to cable ties used in such methods.

BACKGROUND OF THE INVENTION

Airplanes often have an on-board gas turbine engine referred to as an auxiliary power unit that provides electrical power and compressed air to various systems throughout the airplane. When the airplane is on the ground, the auxiliary power unit is the main source of power to drive the environmental control systems, air driven hydraulic pumps, and the starters for the engines. Auxiliary power units may also provide pneumatic and electric power during flight.

In the aerospace industry there are specifications that govern the bounding of electrical cable or wires used on such engines. Honeywell International, which manufactures auxiliary power units, has a fairly typical aerospace specification AF 5483, Revision F for bounding the electrical cables of an auxiliary power unit. Referring to FIG. 1, this specification requires that a bundle 10 comprising a plurality of wires or cables shall be tied with a lacing material 12, per FIG. 1. If the bundle 10 comprises three cables or less, then the first wrap of the cord 12 must be around one of the cables and the second wrap of the cord 12 is around the entire bundle. If the bundle 10 comprises four wires or more, then the first wrap of the cord 12 must be around two adjacent cables and the second wrap of the cord 12 is around the entire bundle. The latter situation is shown in FIG. 1. Once the second wrap is complete, the ends of the cord 12 are secured by a clove hitch secured in a square knot or an anchor hitch as shown in FIG. 1. After trimming the loose ends, the ends of the cord 12 are further secured by saturating them with Humi-Seal, Type IB 15 or equivalent cement.

A typical auxiliary power unit requires, on average, about 105 ties. When assembling the harness, this bounding process is performed one hundred five times. The Applicant has found that it typically takes a skilled assembler about 1½ minutes per tie to perform this bounding method using the cord 12 as set forth in the specification.

Accordingly, there is a need for wire bounding method that can be performed considerably faster than the prior art method. There is also a need for a cable tie that can be used in this improved method. Additionally, there is a need to eliminate the use of the Humi-Seal which is caustic and volatile.

SUMMARY OF THE INVENTION

An object of the present invention is to provide a method for bounding a bundle of wires that can be performed considerably faster than the prior art method.

Another object of the present invention is to provide a cable tie that can be used in this new method.

Yet another object of the present invention is to provide a method for bounding a bundle of wires that does not require the use of a caustic and volatile cement.

The present invention meets these objectives by providing a novel wire bundle bounding method that meets the requirements of aerospace specifications and also uses a novel cable tie. The method starts with a bundle of wires and the cable tie. The cable tie has a strap portion and a locking head with first and second strap passages. The first and second strap passages each have a pawl that locks in the same direction.

The strap portion is then wrapped around at least one of the wires and then inserted through the first strap passage. Then the remaining strap portion is wrapped around the bundle and then inserted through the second strap passage. The strap portion is then tightened and the residual strap portion clipped.

These and other objects, features and advantages of the present invention are specifically set forth in or will become apparent from the following detailed description of a preferred embodiment of the invention when read in conjunction with the accompanying drawings.

DESCRIPTION OF THE PREFERRED EMBODIMENT

Single lock cable ties are well known in the art and are described in U.S. Pat. Nos. 5,146,654, 5,267,373 and 4,688,302 which are incorporated herein by reference to the extent necessary to understand the present invention. These patents are assigned to Panduit Corporation of Tinley Park, Ill. which also sells these cable ties.

Figure 1:
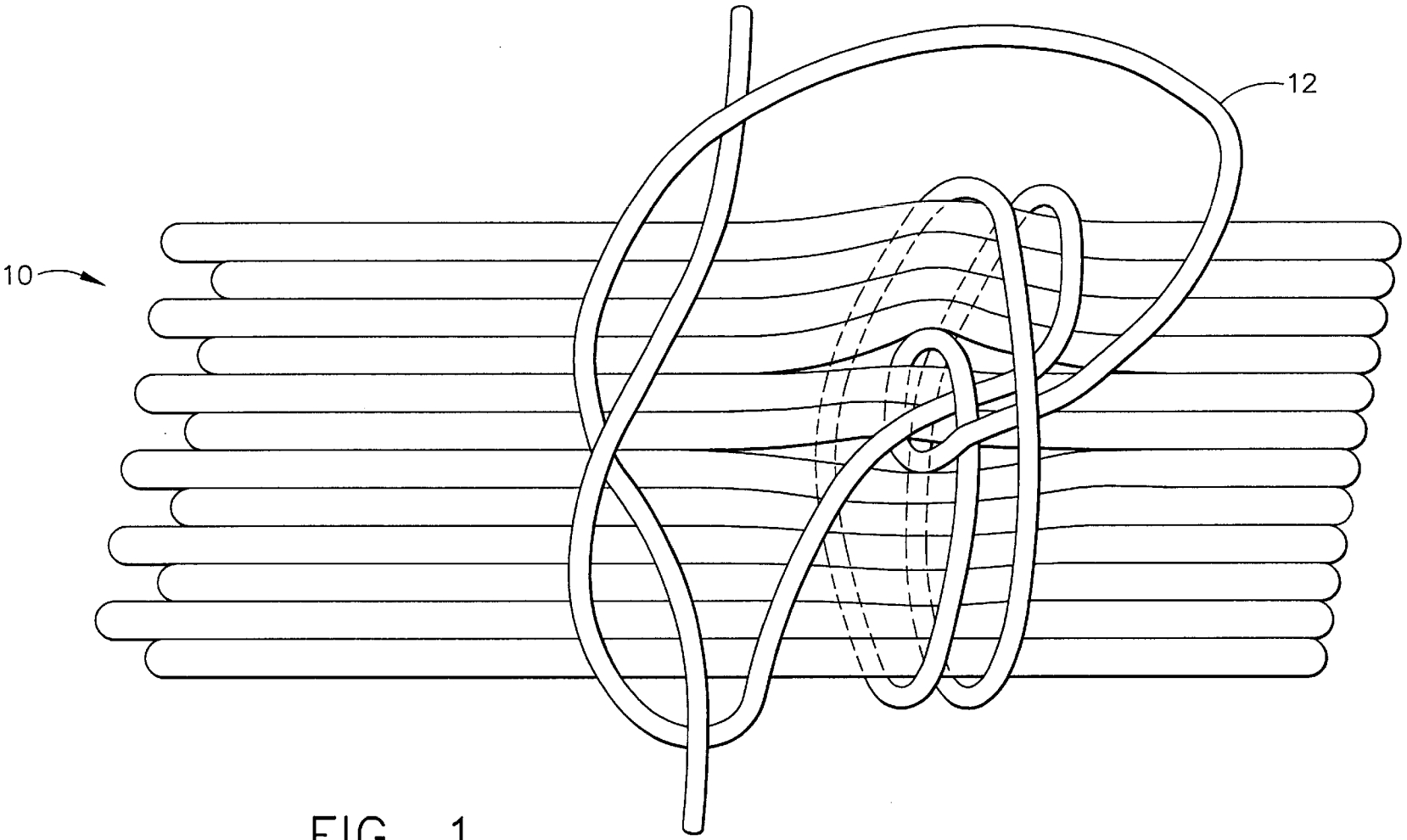
FIG. 1 (PRIOR ART)
FIG. 1 illustrates a bundle of wires bound by a cord in accordance with the prior art method.
Figure 2:
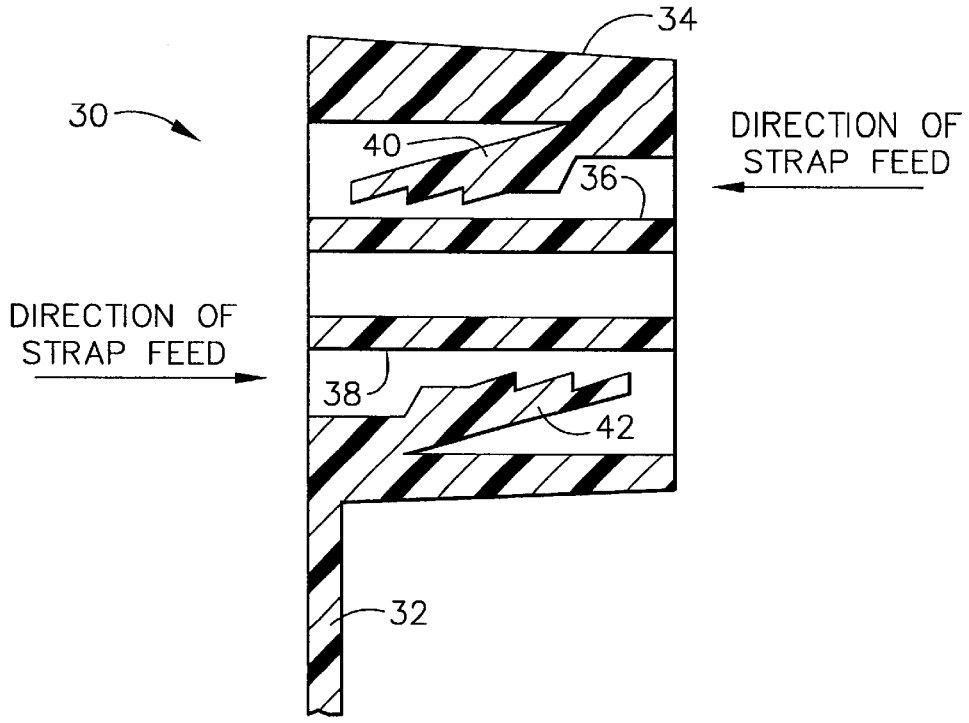
FIG. 2 (PRIOR ART)
FIG. 2 is a cross-section of the head portion of a commercially available double lock cable tie.

Panduit Corporation also sells a double lock cable tie. Referring, to FIG. 2, this double lock cable tie 30 includes a strap body 32 having a free end, not shown, and a locking head 34. If attempted to be used, the free end of the strap 32 is wrapped around a first bundle and inserted through a top strap passage 36 of locking head 34 and then around a second bundle and inserted through a bottom strap passage 38 in the direction opposite to the insertion into the first passage 36. The strap 32 is prevented from being withdrawn by a pawls 40 and 42, engaging with teeth (not shown) formed on the strap body 32. The pawls 40 and 42 are mounted in the passages 36 and 38 respectively and lock in opposite direction. This means that the second wrap must be in the opposite direction from the first wrap and as a consequence, use of the cable tie 30 will not meet the requirements of specification 5483, Rev. F.

Figure 3:
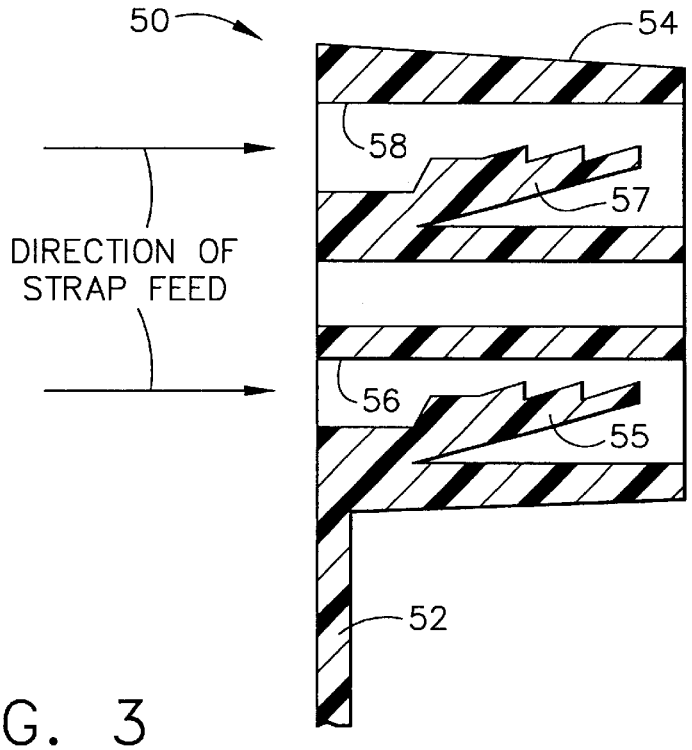
FIG. 3 is a cross-section of the head portion of a double lock cable tie contemplated by the present invention.
Figure 6:
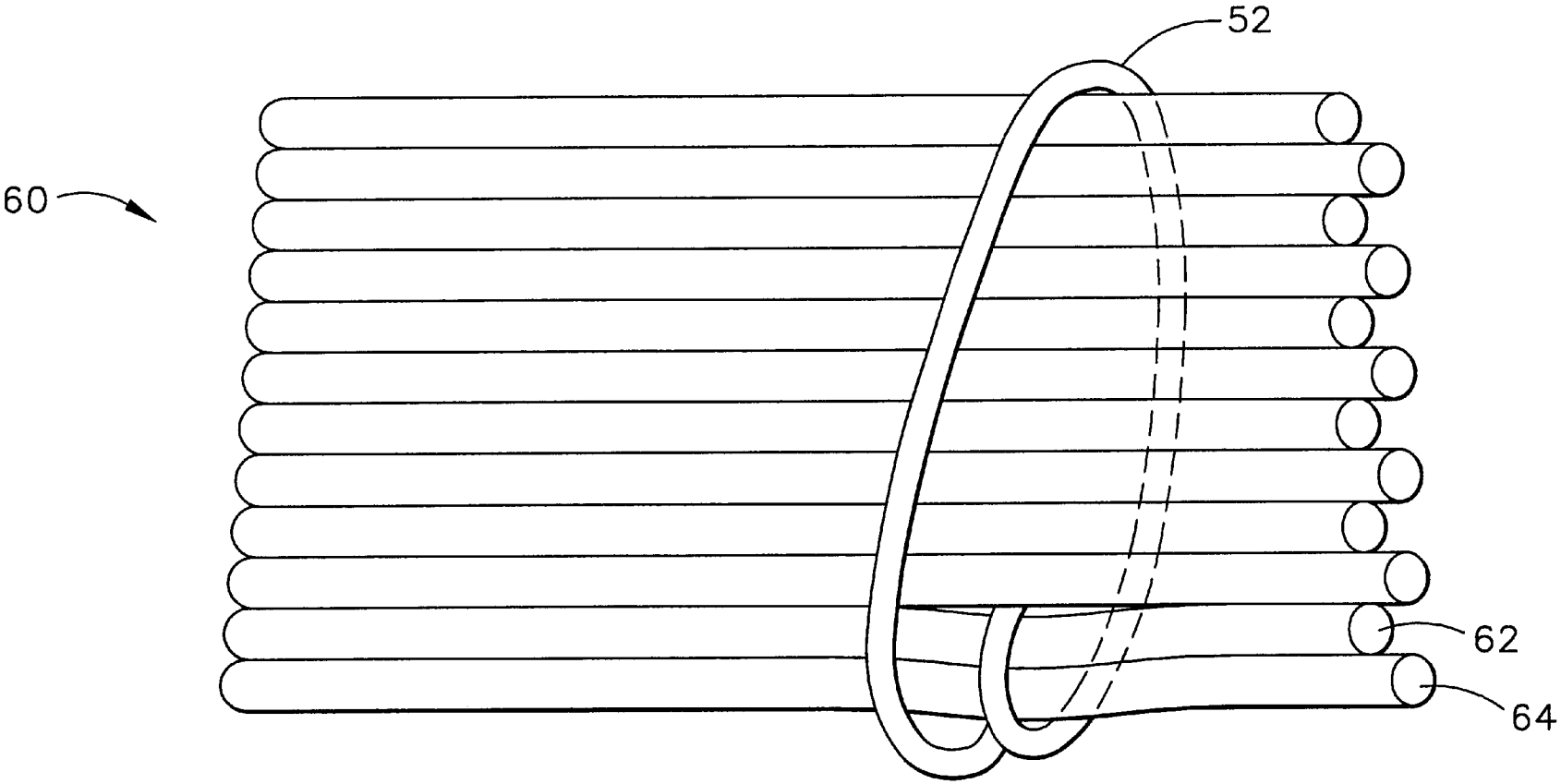
FIG. 6 illustrates a bundle of wires bound by the double lock cable tie in accordance with the method contemplated by the present invention.

Referring to FIGS. 3 and 6, an improved double lock cable tie 50 is shown. The cable tie 50 has a strap body 52 having a free end, not shown, and a locking head 54. In use and in accordance with the specification 5483, Rev. F for the case of a bundle 60 comprising four or more wires, the free end of the strap 52 is wrapped around two adjacent wires 62,64 and then inserted through a bottom strap passage 56 of locking head 54. The strap 52 is then around wrapped around the entire bundle 60 and inserted through a top strap passage 58 in the same direction to the insertion into the bottom passage 56. The strap 52 is then tightened with a tie wrap gun and the residual portion of the strap 52 is then clipped. Importantly, the strap 52 is prevented from being withdrawn by a pawls 55 and 57 engaging with teeth (not shown) formed on the strap body 52. The pawls 55 and 57 are mounted in passages 56 and 58 and are positioned to lock in the same direction.

Figure 4:
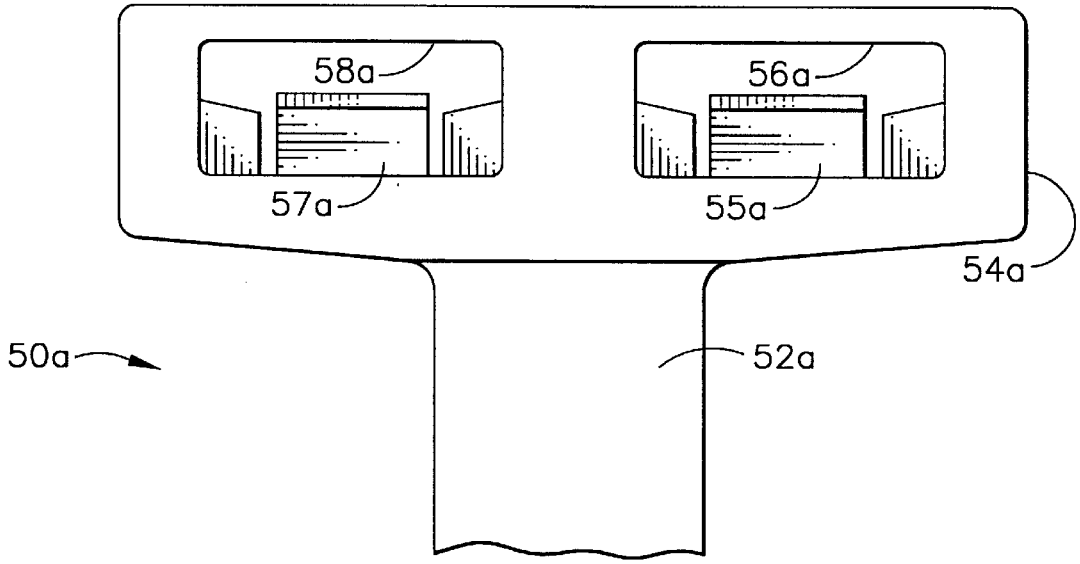
FIG. 4 is a perspective view an alternative embodiment of the double lock cable tie contemplated by the present invention.
Figure 5:
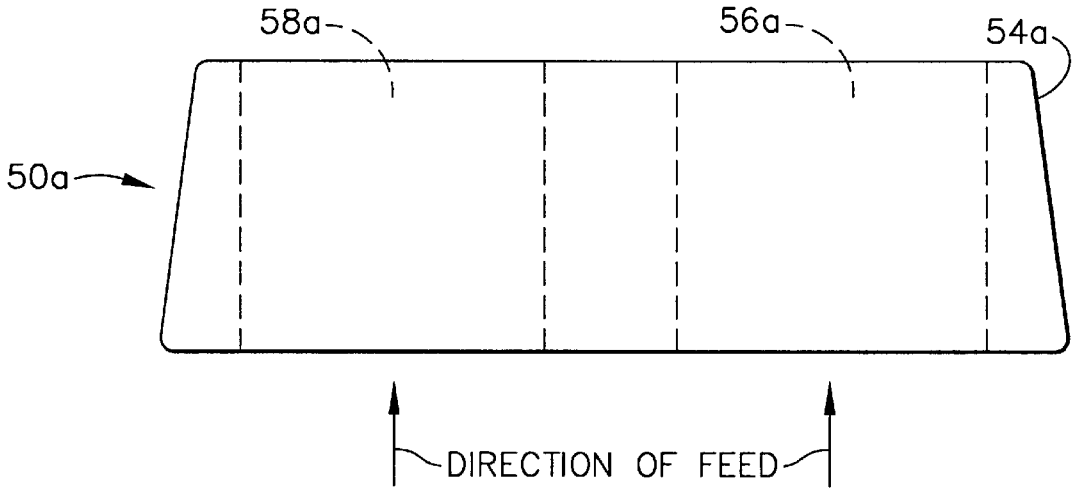
FIG. 5 is a top view of the double lock cable of FIG. 4.

Referring to FIGS. 4 and 5, an alternative embodiment double lock cable tie 50*a* is shown. The cable tie 50*a* is the same as cable tie 50 except in its locking head 54*a* the strap passages 56*a* and 58*a* are lateral with each other as opposed to top and bottom. This configuration has the advantage that for the first wrap, the strap 52*a* can be inserted into either of the strap passages 56*a* or 58*a*. With the cable tie 50, at the completion of the first wrap, the strap 52 had to be inserted into the bottom strap passage 56. The pawls 55*a* and 57*a* are mounted in passages 56*a* and 58*a* respectively and are positioned to lock in the same direction.

The Applicant estimates that it will take a skilled technician about ½ a minute to perform a bounding process using the improved double lock cable ties 50 or 50*a*. This is almost 67 percent reduction in the time it takes to bound a plurality of wires. Further, as the cable ties 50 and 50*a* having locking mechanisms, there is not need for a cement such as Humi-Seal.

It will be appreciated by those skilled in the art that various changes and modifications may be made to the illustrative embodiment without departing from the spirit or scope of the invention. For example, though the present invention has been described with reference to auxiliary power unit, it is applicable to other types of gas turbine engines and to other products outside of the aerospace industry. Therefore, it is intended that the scope of the invention not be limited in any way to the illustrative embodiment shown and described but that the invention be limited only by the claims appended hereto.

What is claimed is:

1. A wire harness bounding method comprising the steps of:

a) providing a bundle of wires;

b) providing a cable tie consisting of a single strap and a locking head with first and second strap passages, said first and second strap passages each having at least one pawl that locks with the strap for a same direction of insertion of the strap through the locking head;

c) wrapping the strap around at least two adjacent wires in the wire bundle and then inserting the strap through the first strap passage;

d) and thereafter wrapping the strap around the entire wire bundle and inserting the strap through the second strap passage.

2. The method of claim 1 further comprising, after step (d), a step of tightening the strap.

3. The method of claim 2 further comprising, after the tightening step, a step of clipping off a residual portion of the strap.

4. A wire harness bounding method comprising the steps of:

a) providing a bundle of wires;

b) providing a cable tie consisting of a single strap and a locking head with first and second strap passages, said first and second strap passages each having at least one pawl that locks with the strap for a same direction of insertion of the strap through the locking head;

c) wrapping the strap around one wire in the wire bundle and then inserting the strap through the first strap passage;

d) and thereafter wrapping the strap around the entire wire bundle and inserting the strap through the second strap passage.

5. The method of claim 4 further comprising, after step (d), a step of tightening the strap.

6. The method of claim 5 further comprising, after the tightening step, a step of clipping off a residual portion of the strap.

7. A double lock cable tie consisting of:

a single elongated strap for wrapping around wires in a bundle of wires, such strap having pawl engagement teeth on at least one side thereof;

a locking head attached to one end of the strap and having first and second strap passages for receiving the single attached strap after different wraps around the wires, each of the first and second strap passages having a pawl for engaging pawl engagement teeth on the strap, the pawls in the two strap passages being oriented in a same direction so as to lock on the strap teeth for the same direction of passage of the strap through the locking head.

* * * * *